US008922447B2

(12) United States Patent
Loh et al.

(10) Patent No.: US 8,922,447 B2
(45) Date of Patent: Dec. 30, 2014

(54) SMART ANTENNA

(75) Inventors: Tian Hong Loh, Teddington (GB); Haitao Liu, Guildford (GB); Steven Gao, Guildford (GB)

(73) Assignee: The Secretary of State for Business Innovation & Skills, London (GB)

( * ) Notice: Subject to any disclaimer, the term of this patent is extended or adjusted under 35 U.S.C. 154(b) by 380 days.

(21) Appl. No.: 13/144,251

(22) PCT Filed: Nov. 15, 2010

(86) PCT No.: PCT/GB2010/051900

§ 371 (c)(1), (2), (4) Date: Dec. 19, 2011

(87) PCT Pub. No.: WO2011/058378

PCT Pub. Date: May 19, 2011

(65) Prior Publication Data

US 2012/0098701 A1 Apr. 26, 2012

(30) Foreign Application Priority Data

Nov. 13, 2009 (GB) ..... 0919948.0

(51) Int. Cl.

| | |
|---|---|
| ***H01Q 19/00*** | (2006.01) |
| ***H01Q 3/44*** | (2006.01) |
| ***H01Q 19/32*** | (2006.01) |
| ***H01Q 1/22*** | (2006.01) |

(52) U.S. Cl.

CPC ..... *H01Q 3/446* (2013.01); *H01Q 19/32* (2013.01); *H01Q 1/22* (2013.01)

USPC ..... 343/833; 343/816

(58) Field of Classification Search

USPC ..... 343/833, 816, 834, 702, 893, 745, 846

See application file for complete search history.

(56) References Cited

U.S. PATENT DOCUMENTS

| | | | | |
|---|---|---|---|---|
| 5,235,343 | A * | 8/1993 | Audren et al. | 343/816 |
| 6,486,847 | B1 * | 11/2002 | Yamamoto et al. | 343/789 |
| 7,385,563 | B2 * | 6/2008 | Bishop | 343/844 |
| 2003/0193446 | A1 * | 10/2003 | Chen | 343/893 |
| 2004/0257292 | A1 | 12/2004 | Wang | |
| 2008/0062058 | A1 * | 3/2008 | Bishop | 343/835 |
| 2008/0266190 | A1 * | 10/2008 | Ohba et al. | 343/702 |

OTHER PUBLICATIONS

International Search Report for International Application No. PCT/GB2010/051900, dated Mar. 3, 2011.

Ojiro, et al. "Improvement of Elevation Directivity for ESPAR Antennas with Finite Ground Plane" IEEE Antennas and Propagation Society International Symposium, Jul. 8, 2001, vol. 4, pp. 18-21.

* cited by examiner

*Primary Examiner* — Thien M Le

(74) *Attorney, Agent, or Firm* — Edward J. Baba; Daniel Stoddard; Bozicevic, Field & Francis LLP

(57) ABSTRACT

A smart antenna assembly includes a driving monopole element and an array of parasitic monopole elements arranged in an annular array around the driving monopole element, wherein the parasitic monopole elements are of bent or curved configuration, bending or curving towards the driving monopole element. Preferably, each parasitic monopole element has a portion thereof which is parallel or substantially parallel to the driving monopole element. The assembly provides a compact steerable antenna assembly.

17 Claims, 5 Drawing Sheets

SMART ANTENNA

The present invention relates to an antenna, in the preferred embodiment a low cost small smart antenna formed of reactive loaded parasitic array radiators. The preferred embodiments are for Wi-Fi communications/WLAN, WiMAX and RFID Applications and so on. The preferred embodiments do not make use of phase shifters for beam forming.

Smart antennae are known in the art, and are of a nature that they are able to detect the location of a particular user and to point their main beam towards that user. It is their beam forming ability that makes smart antennae unique in comparison to other antennae. Beam forming is achieved by a process of phase synthesis. Traditional smart antennae formed of a phase array use a phase shifter to achieve phase synthesis. However, both analogue phase shifters and digital phase shifters are expensive components and result in high-cost smart antennae. Such antennae are therefore not economically viable.

An electronically steerable parasitic array radiator (ESPAR) antenna is a general name describing smart antennae able to achieve phase synthesis without using a phase shifter component. Avoiding a phase shifter can reduce the cost of such antennae. The preferred embodiments of the invention taught herein could be said to belong to the ESPAR family of smart antennae.

ESPAR antennae use a tunable reactive load such as varactors to provide phase synthesis. A typical ESPAR antenna is formed of one driven element and several parasitic elements. The driven element is connected to a radio-frequency (RF) front end and parasitic elements are connected to varactors. The parasitic elements are excited by energy coupled from a driven element.

Theoretically, an ESPAR antenna is composed of a series of ¼ wavelength radiators separated from each other by a ¼ wavelength. These theoretical parameters result in a simple design and a large antenna size.

A problem of existing phase array smart antennae is their high cost and the fact that current ESPAR antennae are large in size, limiting their applications. This can make them unsuitable for a variety of modern devices. For example, for wireless communication systems providing higher data rate and higher quality services, such as a wireless HD video service, antennae with steerable patterns are required to provide a large link budget margin. In next generation wireless networks, systems demand an individual radio link according to position location of the person or entity with which communication is to be effected. Thus, antennae which have a direction finding ability and provide space division according to requirements are needed. However, a standard ¼ wavelength monopole ESPAR antenna is not small enough for portable devices. In particular, when six parasitic ¼ wavelength monopoles surrounding a centre driven ¼-wavelength monopole with a radius of a ¼ wavelength without any optimization, the input impedance will be miss-matched at the centre driven monopole due to the capacitance loading introduced by those six parasitic monopoles. Various optimization methods have been suggested, most focussing on reducing the capacitance load introduced by the parasitic elements, such as increases the length of parasitic monopoles to achieve impedance matching at the driven element, which increases the size of the ESPAR antenna.

The present invention seeks to provide an improved smart antenna.

According to an aspect of the present invention, there is provided an antenna assembly including a driving monopole element and an array of parasitic monopole elements arranged in an annular array around the driving monopole element, wherein the parasitic monopole elements are of bent configuration.

The advantage of bending the parasitic monopole elements is that the height of these elements can be reduced, thereby reducing the height of the antenna assembly itself.

Advantageously, the parasitic monopole elements are bent towards the driving monopole element. In the preferred embodiment, each parasitic monopole element has a portion thereof which is parallel or substantially parallel to the driving monopole element. By reducing the distance between the parasitic elements and the driving monopole element, and/or by providing a part of each parasitic element which is parallel to the driving element, capacitive coupling between the driving and parasitic monopole elements can be optimised.

Advantageously, the driving monopole element is provided with a disk at its extremity. The disk improves capacity of coupling thereby enables a reduction in the size of the antenna assembly.

In the preferred embodiment, there are provided six parasitic monopole elements. Advantageously, the parasitic coupling elements are spaced from one another at an angular spacing of substantially 60°.

Advantageously, the antenna assembly includes a ground sleeve upon which the monopole elements are provided.

In the preferred embodiment, the ground sleeve includes first and second ground plates at either ends thereof of the sleeve, each ground plate including a respective set of driving and parasitic monopole elements. In this manner, a single ground sleeve can support two different effective antenna elements able to generate different beams in different directions. In another embodiment, the two antenna elements could generate analogous beams.

Preferably, the ground sleeve has a depth of ¼ of a wavelength and a radius of 3/16ths of the wavelength to which the assembly is tuned. Preferably, the driving monopole element has a height of ⅛th of the tube wavelength and the parasitic elements a length of ¼ of the tuned wavelength but bent so as to have an maximum height equivalent to that of the driving monopole element.

In some embodiments, it is envisaged that a dielectric top plate may be positioned in contact with the extremities (upper ends) of the driving and parasitic monopole elements. Such a dielectric covering would have the function of protecting the monopole elements and in particular their positions relative to one another during practical use of the antenna assembly.

The preferred embodiment can provide a small ESPAR antenna by employing a capacitor load introduced by a tightly coupled driven element and parasitic elements. More specifically, the preferred embodiment provides a compact electronically steerable parasitic array radiator (ESPAR) antenna which, in the particular embodiment described, covers the frequency band from 2.4 GHz to 2.5 GHz. A top-disk-loaded monopole and folded monopole structures are employed to reduce the height of ESPAR antenna. The heights of top-disk-loaded monopole and folded monopoles have been reduced to be less than ⅛ wavelength, much smaller than ¼ wavelength, that is the height of traditional ESPAR antennae. Furthermore, the distance between the driven element and parasitic elements, that is the radius of the ESPAR module, is also reduced. The preferred ESPAR module achieves a gain of 4.01 dBi and a front-back ratio of 13.9 dB despite its compactness. The beam forming is achieved by tuning the reactive load of the varactors series whose parasitic elements surround the central driven element.

The preferred embodiments taught herein, instead of eliminating the capacitance load, use a folded monopole ESPAR antenna design which takes the advantage of capacitance load to reduce the size of the antenna.

Embodiments of the present invention are described below, by way of example only, with reference to the accompanying drawings, in which.

Figure 1:
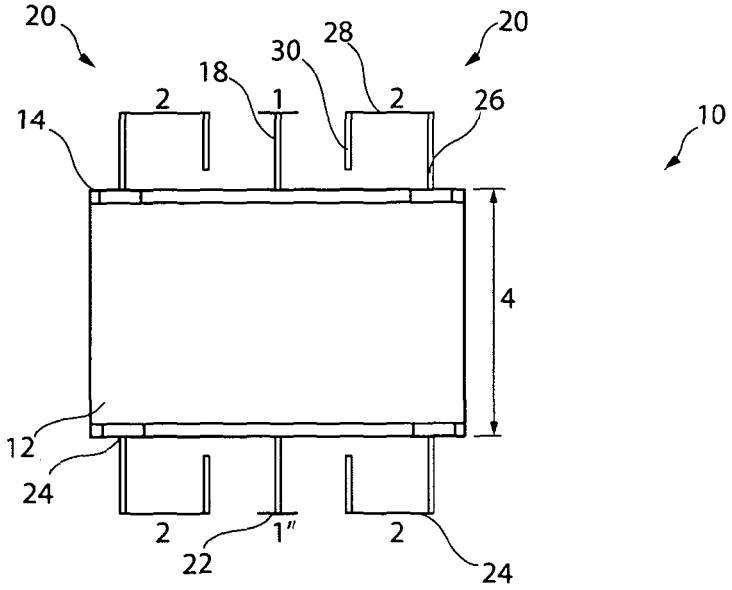
FIG. 1 is a side view of a preferred embodiment of smart antenna.
Figure 2:
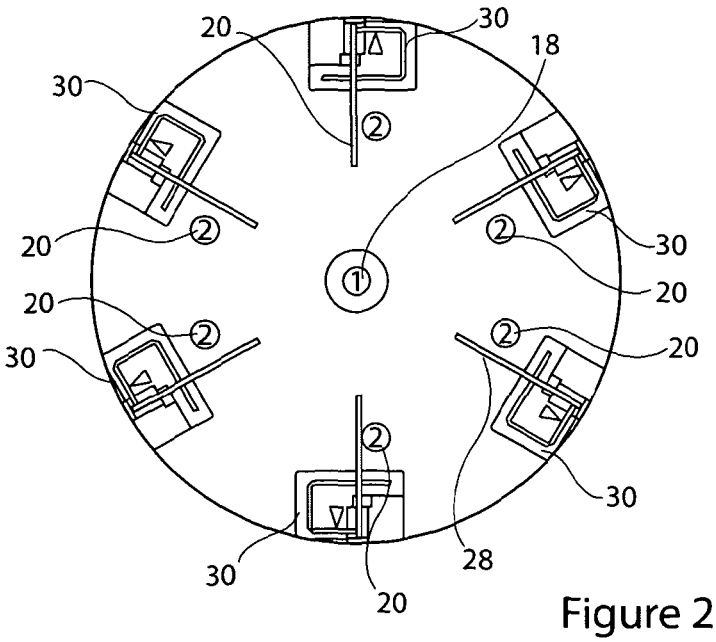
FIG. 2 is a plan view of the embodiment of FIG. 1.
Figure 8:
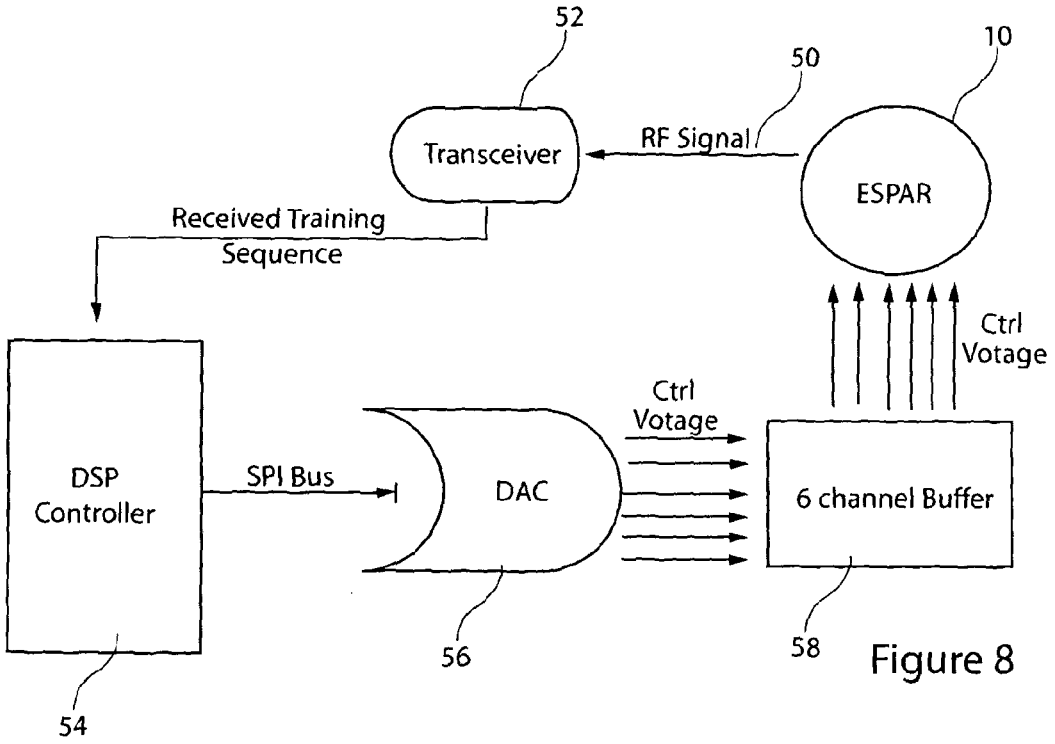
Figure 9:
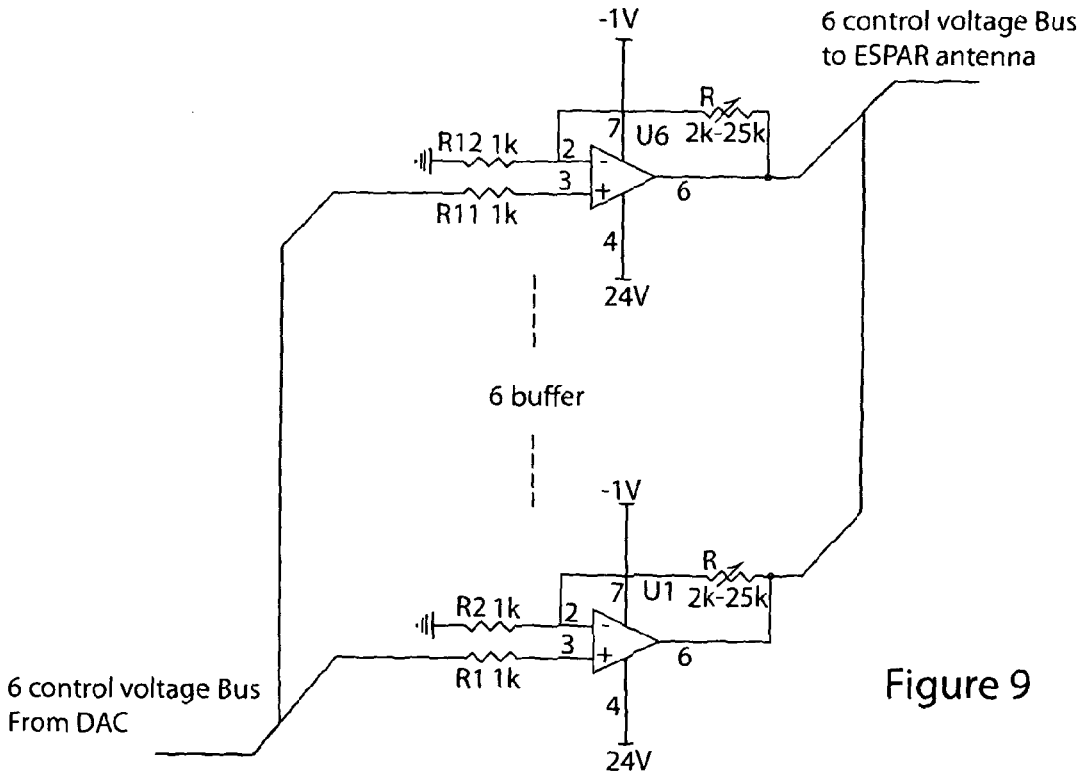

FIG. 8, there is shows in block diagram form an embodiment of circuitry used for driving and deriving signals from one of the sets of monopoles of the assembly of FIGS. 1 and 2; and FIG. 9 shows an embodiment of circuitry for buffer 58 shown in FIG. 8.

It is to be understood in the description which follows that references to parallel, perpendicular, straight and so on characteristics include also substantially parallel, substantially perpendicular, substantially straight and so on.

Referring to FIG. 1, there is shown the preferred embodiment of smart antenna 10, which is small smart electrical antenna based upon an ESPAR structure. The antenna 10 includes a ground sleeve 12 which is of hollow circular cylindrical form clad in copper, in the preferred embodiment. Substantially flat end plates 14, 16 are provided at either end of the ground sleeve 12 and face opposing directions. The end plates 14, 16 are of a substantially circular, disc-shaped, form.

Provided on each end plate 14, 16 are a plurality of monopole structures 18, 20; 22, 24. Referring to the upper end plate 14, as seen in FIGS. 1 and 2, there is provided at the centre of the disc 14 a central driven antenna monopole element 18 which is straight and extends perpendicular to the plane of the top disc 14. At the end of the antenna element 18 there is provided a top disc element 19 which is parallel to the ground plane 14.

The central monopole antenna element 18 forms the driven element of the antenna structure 10. Arranged in a regular array around the central monopole element 18 is a series of parasitic monopole elements 20. In this embodiment there are provided six parasitic monopole elements 20, angularly spaced from one another by 60° and arranged in a circular array around the central element 18. Each monopole element 20 is bent towards the centre driven element 18. In the embodiment shown, each bend element 20 is of a folded configuration and includes (i) a base element 26 extending perpendicularly from the ground disc 14 and thus aligned with the driven monopole 18, (ii) an arm section 28 extending radially towards the centre monopole 18 and parallel to the ground plane 14, and (iii) a depending finger 30 parallel to the base element 26 and the centre monopole 18.

The monopole structures of the other ground plane disc 16 are analogous to those of the disc 14 and are thus not described herein in further detail.

By using a top-disc loaded monopole 18 and folded monopoles 20 as taught herein, a compact size of antenna structure 10 can be achieved. The top disc loaded monopole 18 is used as a centre driven element while the folded monopoles 20 are used as parasitic elements. The folded monopoles 20 bend towards the centre driven element to provide strong coupling and capacitance load.

The RF front end is connected with the top disc loaded monopoles 18 and 22 through a 180° power divider. The top disc loaded monopoles 18, 22 work as driven elements. They have a height of ⅛ wavelength. The circling radius is less than ¼ wavelength, in this example 3/16 wavelength.

Each centre driven element 18, 22, that is the top-disk loaded monopole 18, 22, connects with 50 Ohm RF port.

The folded monopoles 20, 24 work as parasitic elements circling their respective driven element 18, 22 with a separation angle of 60° with respect to the centre driven element. The ground sleeve 12 has a height of a ¼ wavelength and a radius of 3/16 wavelength.

Thus, as can be seen in FIG. 1, the preferred embodiment of antenna 10 has a height for the top-disk loaded monopole 18, 22 and folded monopoles 20, 24 of less than ⅛ wavelength; the total length of folded monopoles 20, 24 is slightly longer than ¼ wavelength; the distance between driven element 18, 22 and parasitic elements 20, 24 is less than ¼ wavelength.

The antenna 10 is tuned to a particular frequency by selection of the dimensions of its components. It can be tuned to a large range of frequencies by being designed to the associated wavelength.

Referring to the plan view of FIG. 2, a control voltage is applied to tunable reactive components such as varactors through a DC-feeding network 30 provided on each parasitic monopole 20, 24. Pattern steering and beam forming is performed by tuning the voltage applied over varactors, which series parasitic folded monopole to ground. This is described in further detail below.

The parasitic elements 20, 24 not only contribute to the pattern diversity, but also contribute to size reduction. The idea of the proposed antenna is to reduce the monopole size by providing a large capacitance load. To increase the capacitance load, the distance between the driven element and the parasitic elements is reduced and thus the radius of the ESPAR antenna can be reduced. The maximum gain has been sacrificed due to the reduced distance between driven element 18, 22 and the parasitic elements 20, 24. However, the gain is optimized when the distance between driven element and parasitic elements is ¼ wavelength.

The height of ground sleeve plane 12 is ¼ wavelength and this is used to tune the main beam of the ESPAR antenna into the horizontal plane. Without the ground sleeve plane 12, the main beam will see an elevation angle in vertical plane.

It is to be appreciated that the embodiment of antenna assembly 10 shown in FIGS. 1 and 2 is a double antenna structure in which the top and bottom monopole sets can act to provide different antenna functions. For instance, the top monopole structure can be used to steer a beam in the direction of a communications base station while the lower monopole structure used to steer a second beam in the direction of another user. Such a double antenna design can be very useful in providing for the steering of different beams simultaneously while making use of a common ground sleeve 12, thereby further minimising space taken by the antenna structure.

In other embodiments, the antenna assembly 10 can be provided with only one set of monopoles, at one end of the ground sleeve 12, thus providing a single steerable beam and thus a simpler structure. Similarly, an arrangement with a double set of monopoles could be set up to generate the same types of beams by feeding analogous electrical signals to them.

Simulation and Measurement

First, the preferred embodiment of ESPAR antenna was simulated in CST Microwave Studio. Its input impedance matching is optimized for six main patterns and six sub-main patterns. Main patterns are defined as one varactor operated with a 25V control voltage and other five varactors operated with a 1.4V control voltage. The positions of the six parasitic elements 20, 24 are defined as 30°, 90°, 150°, 210°, 270° and 330°. The direction of those six main patterns are 30°, 90°, 150°, 210°, 270° and 330° correspondingly.

Sub-main patterns are defined as two varactors operated with 20V control voltage and four other varactors operated with 1.4V control voltage. The position of the six parasitic elements are defined as 30°, 90°, 150°, 210°, 270° and 330°. The direction of those six main patterns are 0°, 60°, 120°, 180°, 240° and 300° correspondingly.

By submitting self-input impedance and mutual impedance into equation (1), the surface current $\vec{I}$ of each antenna element can be calculated.

$$\vec{I} = \frac{\vec{V}}{[Z_A + Z_L]} \tag{1}$$

In equation (1), $Z_A$ is the impedance matrix without a reactive load; $Z_L$ is the loading impedance matrix when varactors tuned by a control voltage; and V is the port voltage.

By submitting surface current vector $\vec{I}$ into equation (2), the E field pattern at distance of r and in the azimuth direction 8 can be calculated.

$$E_{(\theta)} \propto \frac{1}{r^2} \cdot I^T \cdot \alpha(\theta) \tag{2}$$

where $\alpha(\theta)$ is the steering vector defined by equation (3)

$$\alpha(\theta) = \begin{bmatrix} 1 \\ e^{j\frac{\pi}{2}\cos(\theta)} \\ e^{j\frac{\pi}{2}\cos(\theta-\frac{\pi}{3})} \\ e^{j\frac{\pi}{2}\cos(\theta-\frac{2\pi}{3})} \\ e^{j\frac{\pi}{2}\cos(\theta-\pi)} \\ e^{j\frac{\pi}{2}\cos(\theta-\frac{4\pi}{3})} \\ e^{j\frac{\pi}{2}\cos(\theta-\frac{5\pi}{3})} \end{bmatrix} \tag{3}$$

Equations 1 to 3 have been implemented in Matlab to build a numerical model to calculate far field pattern of the preferred embodiment of antenna and testify the beam forming algorithm.

Main Pattern Plot

Figure 3:
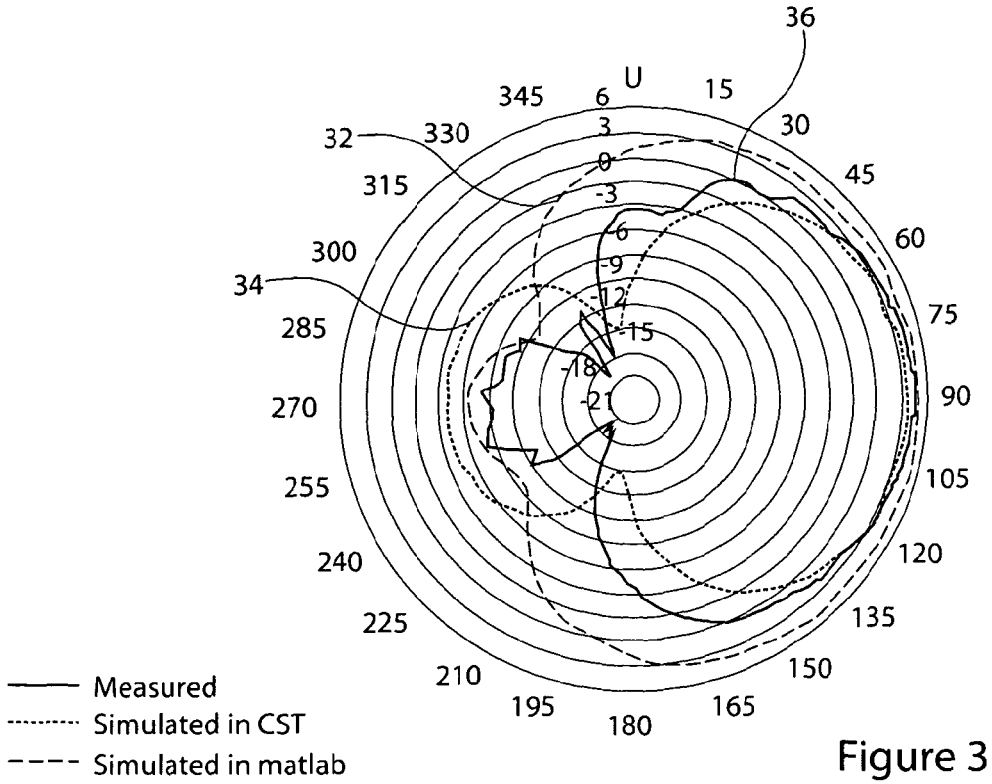
FIG. 3 shows a radiation pattern at 90° for the embodiment of antenna of FIGS. 1 and 2.

One of the main patterns, which is located at 90°, is shown in FIG. 3. The dotted line 32 is the radiation pattern calculated from mutual impedance and self-impedance based a numerical model in Matlab. The line 34 represents the realized gain simulated in CST Microwave Studio and line 36 represents the measured antenna gain in a test chamber.

FIG. 3 shows that the measured pattern agrees with the simulated pattern well and that the maximum gain of the measured gain is 3.30 dBi. The front-back ratio of the measured main pattern is 11.30 dB.

The pattern shown in FIG. 3 can be achieved at 30°, 90°, 150°, 210°, 270° and 330° by tuning control voltage.

Sub-Main Pattern Plot

Figure 4:
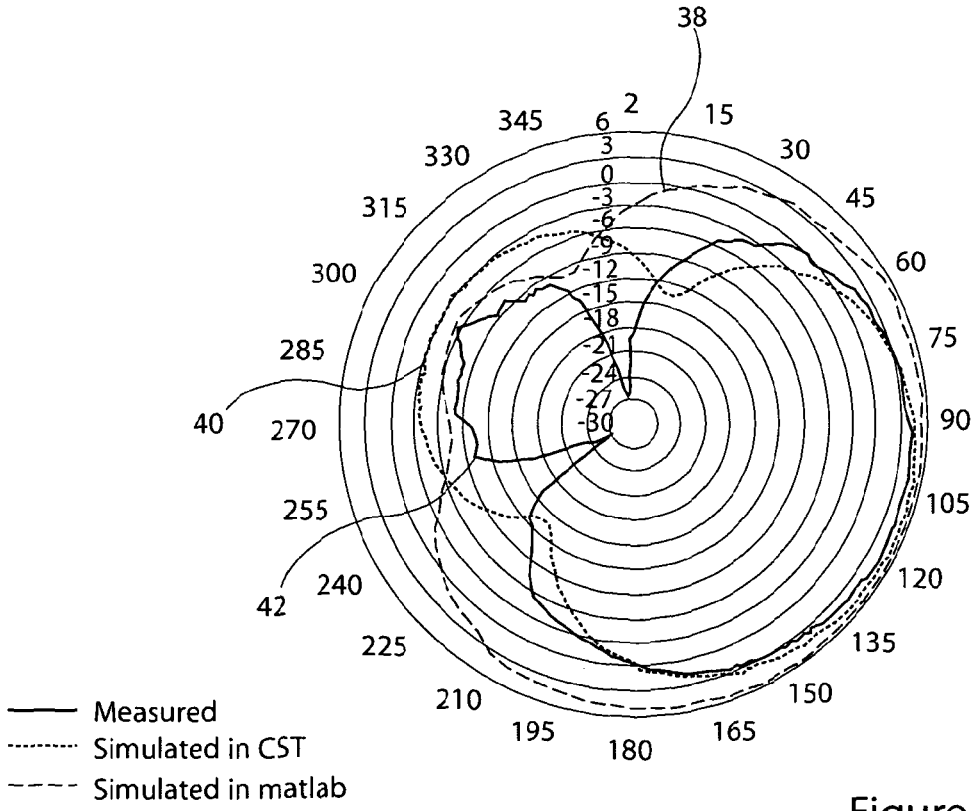
FIG. 4 shows a radiation pattern at 120° for the embodiment of antenna of FIGS. 1 and 2.

One of the sub-main patterns, which located at 120°, is shown in FIG. 4. The dotted line 38 is the radiation pattern calculated from mutual impedance and self-impedance based numerical modelling in Matlab. Line 40 represents the realized gain simulated in CST Microwave Studio and line 42 represents the actual measured antenna gain in a test chamber.

The measured gain of sub-main pattern is 3 dBi and the front-back ratio is 10 dB. The pattern shown in FIG. 4 can be achieved at 0°, 60°, 120°, 180°, 240° and 300° by tuning control voltage applied to varactors.

Enhanced-Main Pattern Plot

In order to increase the front-back ratio, the back lobe cancelling calculation has been performed by using numerical model programmed in Matlab. The back lobe cancelling method has been studied as well.

According to the calculation, when applying control voltage vector [23V 15V 3V 3V 3V 15V] to varactors, the back lobe can be reduced. At the same time, the gain is optimized. The radiation pattern achieved under such control voltage set up is defined as the "enhanced-main pattern".

Figure 5:
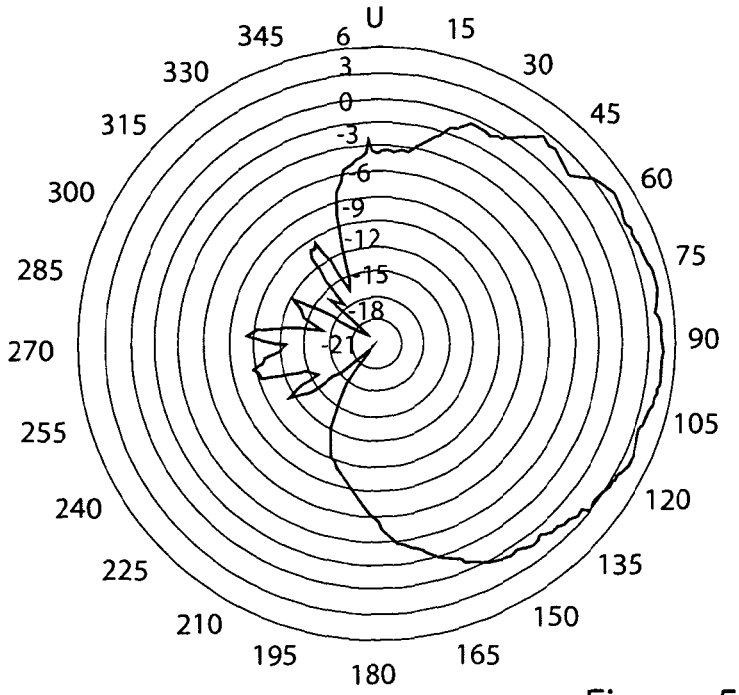
FIG. 5 shows the measured radiation pattern at 90° for the embodiment of antenna of FIGS. 1 and 2.

The radiation pattern of enhance-main pattern is given in FIG. 5. The maximum gain of the enhanced mode is 4.01 dBi and the front-back ratio is 13.90 dB.

Adaptive Beam Forming

The adaptive beam steering method enables the ESPAR antenna to estimate the direction of the desired signal and form the main lobe towards the desired signal and automatically forms null at direction of interference. The adaptive algorithm applied to the ESPAR antenna in the preferred embodiment is an un-blinded algorithm, for which there is provided a reference signal to carry out the adaptive algorithms. For the sake of descriptive efficiency and conciseness, only the line of sight propagation environment is described and the multipath component is not described but will be apparent to the person skilled in the art.

First, the method will search the best cross correlation co-efficiency (CCC) value from those six main patterns and determine the starting point of the following iteration. After determining the starting point, the method then iterates following the steepest gradient of CCC.

The maximum gain is not always pointing at direction of desired signal. The preferred method scarifies maximum gain at direction of desired signal in order to achieve a deep null at direction of interference signal.

The control voltage vector is recorded and applied to ESPAR antenna 10 when measured in a test chamber. There is no training signal applied when carrying out pattern measurement in the chamber. The measured pattern comparing the pattern simulated in CST for the same control voltage set up is given in FIG. 6.

Figure 6:
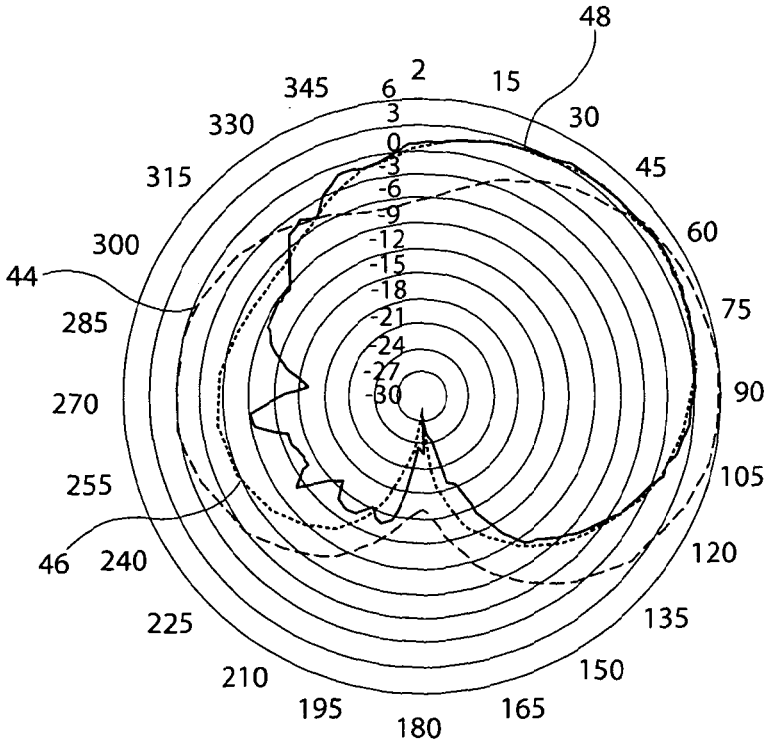
FIG. 6 shows the null formed at 180° and the desired signal at 90° for the preferred embodiment of antenna structure.

In FIG. 6, the dotted line 44 is the radiation pattern calculated from a mutual impedance and self-impedance based numerical model in Matlab. The line 46 represents the realized gain simulated in CST and the line 48 represents the measured antenna gain in a test chamber.

The Control voltage vector was as follows:

[20V 12V 10V 1.4V 1.4V 5V]

Figure 7:
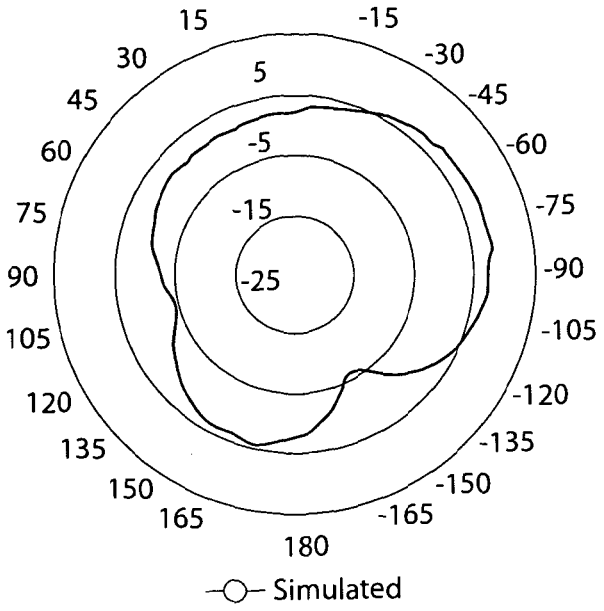
FIG. 7 shows an example of radiation pattern at an elevation plane out of six main patterns or sub-main patterns.

FIG. 7 shows an example of radiation pattern at an elevation plane out of six main patterns or sub-main patterns.

Circuitry

The circuitry for the antenna assembly 10 disclosed herein should be apparent to the person skilled in the art having regard to the teachings above. Nevertheless, for the sake of completeness, FIGS. 8 and 9.

Referring first to FIG. 8, there is shown in block diagram form an embodiment of circuitry used for driving and deriving signals from one of the sets of monopoles of the assembly of FIGS. 1 and 2. The circuitry includes a feed (wires) 50 from the monopoles 18, 20 or 22, 24 of the antenna assembly 10, coupling to a transceiver 52. The transceiver 52 is coupled to a digital signal processing controller 54 which is operable to feed steering signals to the antenna 10, through a six channel digital to analogue converter 56 and a six channel buffer 58. An embodiment of circuitry for the buffer 58 is shown in FIG. 9, the components of which will be understandable by the person skilled in the art.

Table 1 shows a size comparison between the preferred embodiment of antenna structure taught herein and a standard ¼ wavelength ESPAR antenna. It can be seen that the savings in space are significant.

| ESPAR antenna type | radiator height | distance between radiator | sleeve ground radius | sleeve ground height |
|---|---|---|---|---|
| Proposed Compact ESPAR | 12 mm <0.125λ | 23 mm <0.25λ | 23 mm <0.25λ | 31 mm 0.25λ |
| Standard Seven Element ESPAR | 31 mm 0.25λ | 31 mm 0.25λ | 62 mm 0.5λ | 31 mm 0.25λ |

The above embodiments have been described in connection with a six parasitic monopole antenna arrangement. The use of six monopole elements 20, 24 is preferred as this gives an optimal balance between power and steerability. However, it is envisaged that a different number of monopole elements 20, 24 could be used, for instance 3, 4, 8 or 12. Other number of parasitic monopoles could be used in dependence upon the particular application.

The preferred embodiment also uses parasitic monopoles 20, 24 which are bent to have portions which are parallel to the driving monopole 18, 22 and shapes which could be said to be square J shapes. In other embodiments the parasitic monopoles could have other shapes such as curved. It is preferred, however, that the parasitic monopoles 20, 24 have at least one section/part which is parallel to the driving monopole 18, 22 as this optimises capacitive coupling. In this regard it is preferred that the parallel part or section is that closest to the driving monopole 18, 22.

Other modifications and applications can be envisaged, as detailed in what follows.

Novel techniques of reducing antenna size can also be investigated by using high-permittivity dielectric loading, meta-material structures and so on.

To further reduce the size and improve the efficiency of the smart antenna, active integrated antenna techniques can be investigated, where the antenna, RF amplifier circuit and RF mixer circuits are integrated together, thus minimizing the circuit losses in the system.

For optimum control of reactive elements and hence the antenna radiation patterns, robust DSP algorithms can be investigated and the DSP hardware implementations will use FPGA.

The inventors also foresee wider use or development of the teachings herein. The following aims to provide the application ideas on targeted market for a low cost compact ESPRA smart antenna.

The rapid growth of the wireless communications market has resulted in huge demands in new technologies being investigated to improve performance and usage of the available spectrum in the most efficient way. By forming the maximum radiation towards the desired users and nulls towards the interference sources, smart antenna technology has the capability to extend the range and increase efficiency and hence improve the performance of wireless communication links for nearly every wireless communications technology. The factors determining technology uptake are not the price of the product, hence the product density triggers smart antenna adoption. The smart antenna technology together with software defined radio techniques can integrate Bluetooth, Wi-Fi, UWB and WiMAX into a single device package. The requirements for broadband access solutions have begun to emerge in the market and companies are forced to consider the possibility of integrating several wireless protocols into the same device. Today companies in the Europe, US and Japan are in high gear to take advantage of the benefits that smart antennae technology promise. The following applications are identified for low cost compact size ESPAR antennae.

WiMAX

WiMAX is one of the strongest drivers for smart antenna technology today. Furthermore, the low cost of the WiMAX spectrum compared to 3G is a clear driver for service providers to enter the field of wireless services with WiMAX. This difference in cost/Hz is particularly significant in Europe, where the average 3G spectrum cost/Hz is 353 times higher than the average WiMAX spectrum cost/Hz.

Wi-Fi Communications/WLAN

Smart antenna technology can promise range extension and capacity gain and hence driving smart antenna adoption in WLAN hotspot applications. Furthermore, MIMO will be prevalent in WLAN range extension applications.

3 G Communication Base Station/Tower

In communication markets smart antenna technology offers CDMA interference reduction and capacity enhancement to 3G handsets and communication base stations/towers.

DVB-T Reception

The ESPAR smart antenna can be improved to have wideband characteristic so it can also be suitable for application as portable Terrestrial Digital Video Broadcasting (DVB-T) reception.

Mobile Wireless Communication Terminals

As portability is a key requirement for mobile wireless communication terminals, the size of the antenna will be important.

RFID Applications

An ESPAR antenna could contribute tremendously in the areas of RFID tag reading system reading rates, collision mitigation, location finding of items and capacity improvement of the RFID systems.

Satellite Communications and Inter-Satellite Communications

The present ESPAR design has linear polarisation. The extension/modification of the current design to circular polarisation small smart antennae would be very useful for beam steering and space deployment applications for satellite communications and inter-satellite communications.

The disclosures in British patent application number 0919948.0, from which this application claims priority, and in the abstract accompanying this application are incorporated herein by reference.

The invention claimed is:

1. An antenna assembly including a driving monopole element and an array of parasitic monopole elements arranged in an annular array around the driving monopole element, wherein the parasitic monopole elements are of bent or curved configuration; wherein the driving monopole element has a height of substantially ⅛th or less than an ⅛th of the tuned wavelength and the parasitic elements a length of substantially ¼ of the tuned wavelength but bent or curved so as to have a maximum height equivalent to that of the driving monopole element.

2. An antenna assembly according to claim 1, wherein the parasitic monopole elements are bent or curved towards the driving monopole element.

3. An antenna assembly according to claim 1, wherein each parasitic monopole element has a portion thereof which is parallel or substantially parallel to the driving monopole element.

4. An antenna assembly according to claim 1, wherein the driving monopole element is provided with a disk at its extremity.

5. An antenna assembly according to claim 1, wherein there are provided six parasitic monopole elements.

6. An antenna assembly according to claim 1, wherein the parasitic monopole elements are spaced from one another by a regular angular spacing.

7. An antenna assembly according to claim 1, including a ground sleeve upon which the monopole elements are provided.

8. An antenna assembly including a driving monopole element and an array of parasitic monopole elements arranged in an annular array around the driving monopole element, wherein the parasitic monopole elements are of bent or curved configuration, and wherein the driving monopole element has a height of substantially ⅛th or less than an ⅛th of the tuned wavelength and the parasitic elements a length of substantially ¼ of the tuned wavelength but bent or curved so as to have a maximum height equivalent to that of the driving monopole element; and a ground sleeve upon which the monopole elements are provided, wherein the ground sleeve includes first and second ground plates at either ends thereof of the sleeve, each ground plate including a respective set of driving and parasitic monopole elements.

9. An antenna assembly according to claim 8, wherein the first and second ground plates including the respective set of driving and parasitic monopole elements provide two antenna elements, wherein the two antenna elements are able to generate analogous beams.

10. An antenna assembly according to claim 8, wherein the ground sleeve has a depth of substantially ¼ of a wavelength and a radius of substantially 3/16ths of the wavelength to which the assembly is tuned.

11. An antenna assembly according to claim 1, wherein a dielectric top plate may be positioned in contact with the extremities of the driving and parasitic monopole elements.

12. An antenna assembly according to claim 1, wherein the assembly provides a compact electronically steerable parasitic array radiator (ESPAR) antenna.

13. An antenna assembly according to claim 12, wherein the antenna covers a frequency band from 2.4 GHz to 2.5 GHz.

14. An antenna assembly according to claim 1, wherein the assembly provides a double antenna structure in which top and bottom monopole sets can act to provide different antenna functions.

15. An antenna assembly according to claim 14, wherein a first monopole structure is operable to steer a beam in the direction of a communications base station while a second monopole structure is operable to steer a second beam in the direction of another user.

16. A method of operating an antenna assembly according to claim 1, including the steps of providing adaptive beam steering of the antenna in order to estimate a direction of a desired signal and form a main lobe towards the desired signal and automatically form null at direction of interference.

17. A communications system including an antenna assembly according to claim 1.

* * * * *